United States Patent [19]

Bobren

[11] 4,200,214

[45] Apr. 29, 1980

[54] ADJUSTABLE MAGAZINE FOR FASTENER DRIVING TOOL

[75] Inventor: Allan J. Bobren, Des Plaines, Ill.

[73] Assignee: Swingline, Inc., Long Island City, N.Y.

[21] Appl. No.: 904,567

[22] Filed: May 10, 1978

[51] Int. Cl.[2] ..... B25C 1/04

[52] U.S. Cl. ..... 227/109; 227/127

[58] Field of Search ..... 227/109, 127, 120

[56] References Cited

U.S. PATENT DOCUMENTS

| | | | |
|---|---|---|---|
| 3,037,207 | 6/1962 | Pazan | 227/109 |
| 3,554,428 | 1/1971 | Smith | 227/109 |
| 3,946,927 | 3/1976 | Fehrs | 227/127 X |
| 4,126,258 | 11/1978 | Martin et al. | 227/109 X |

*Primary Examiner*—Paul A. Bell

*Attorney, Agent, or Firm*—Pennie & Edmonds

[57] ABSTRACT

A magazine having an upper fastener holding chamber including a floor, a lower housing and a magazine cover that can be adjusted to a number of heights above the chamber floor without such cover being removed or the interconnectors used to secure the cover to the housing being disassembled. Alignment positioning of the magazine cover at a selected height above the floor is accomplished by locating pins and complementary holes.

2 Claims, 2 Drawing Figures

10
11
12
13
14
15
16
17
18
19
21
22
23
24
25
26
27
28
31
32
33
35
36
37
2
2

ADJUSTABLE MAGAZINE FOR FASTENER DRIVING TOOL

BACKGROUND OF THE INVENTION

Prior fastener driving devices have employed magazines capable of adjustment to accommodate fasteners of differing sizes. One such device employs a magazine including retainer blocks located within a hollow interior, the blocks are capable of removal from one lower location and replacement at a different upper location within the magazine. During the cover adjustment, threaded cover bolts are removed from their original holes and replaced in different bolt-receiving holes.

Another magazine adjustability arrangement is found in U.S. Pat. No. 3,037,207 issued June 5, 1967.

The present invention is a magazine for a fastener tool which magazine has a fastener holding chamber including a floor on which the nested fasteners rest, housing below the floor and an L-shaped cover with the side piece of the cover adjustably attachable to the magazine housing. Interconnectors including nuts and bolts are used to secure the cover to the housing in a plurality of positions without detaching one from the other. Positioning of the cover on the housing is accomplished by alignment pins and complementary pin-receiving holes on the cover and housing.

It is a feature that the adjustment can be made without disassembling any part of the magazine arrangement.

It is also a feature that adjustment can be accomplished simply and swiftly with ordinary hand tools.

THE PREFERRED EMBODIMENT OF THE INVENTION

Figures 1, 2:
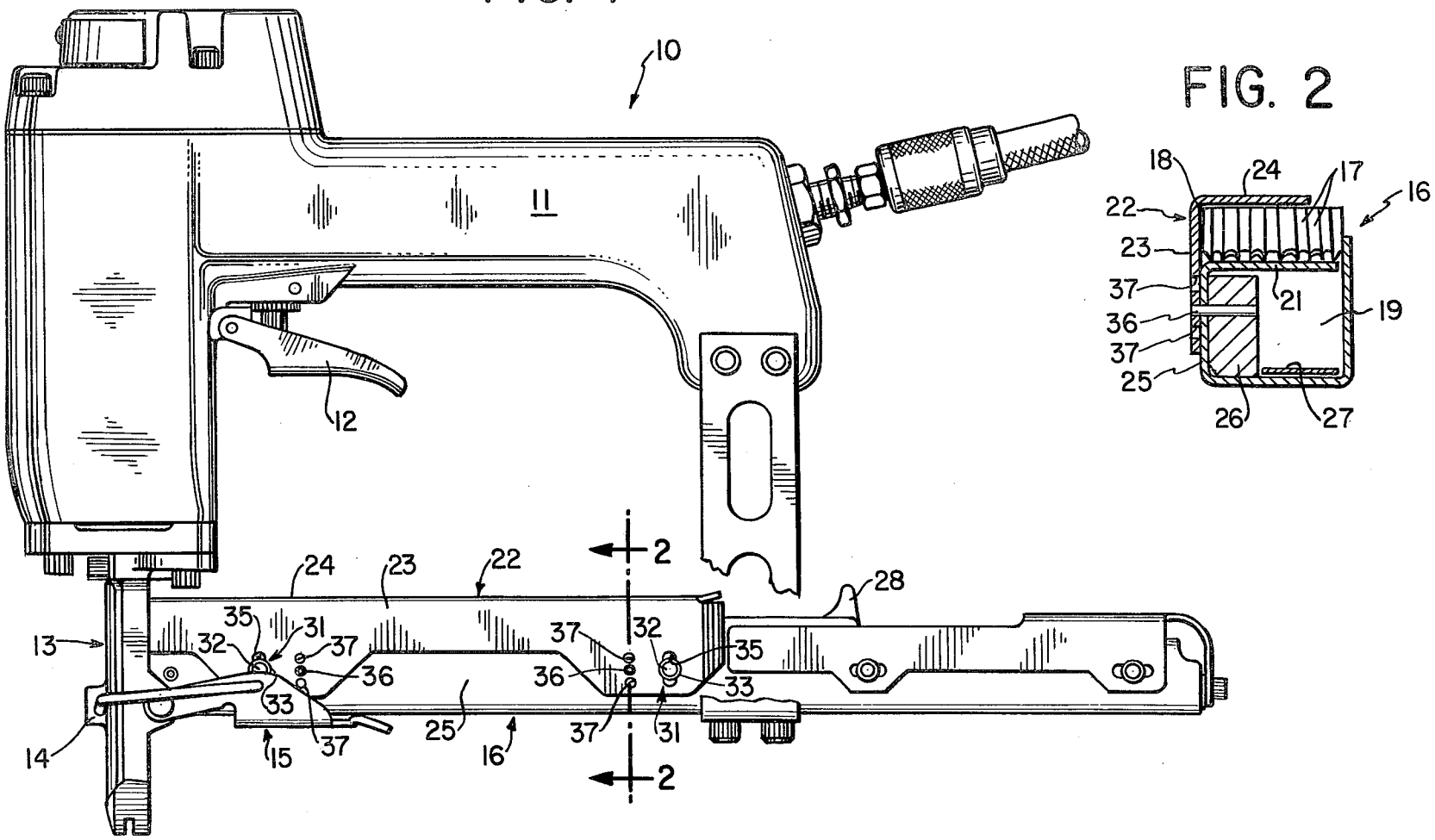
FIG. 1 is a side elevational view of the tool.
FIG. 2 is a sectional view taken along line 2—2 of FIG. 1.

In the drawings, tool 10 includes handle 11, trigger 12 driving blade receiving chamber 13, chamber door 14, door clamping arrangement 15 and magazine 16.

Magazine 16 holds and feeds nested corrugated fasteners 17 to the fastener chamber 13 from which fasteners are driven into a work piece (not shown). Magazine 16 comprises two superimposed internal longitudinal portions, the upper fastener holding chamber 18 and the lower pusher assembly housing 19. Other types of fasteners, such as brads or nails, may be used with suitable modification of the magazine.

Fastener holding chamber 18 is defined by fastener support floor 21 and L-shaped hold-down cover 22. Hold-down cover 22 includes vertical cover side piece 23 and cover lid member 24. Pusher assembly housing 19 includes vertical wall 25 attached to floor 21. Frame piece 26 and coil spring 27 (which tensions fastener pusher 28) are positioned in housing 19.

The length of fasteners 17 varies depending on the fastening job to be done. When longer (or shorter) fasteners are to be used, the position of cover 22 must be adjusted to accommodate the new fastener length.

Cover 22 is secured to vertical wall 25 by interconnectors 31 comprising bolts 32 extending through vertical wall 25, passing through slots 35 in side piece 23 and engaged with side piece 23 by nuts 33. Nuts 33 are threadedly engaged on bolts 32 and are turned using Allen heads or other gripping arrangements. Nuts 33 may be screwed toward the ends of bolts 32 but, preferably, are not removable therefrom.

Cover 22 is aligned and located vis-a-vis wall 25 by two spaced-apart locating pins 36 extending through vertical wall 25 together with locating holes 37 in cover side piece 23.

In the operation of the invention; the magazine cover 22 is adjusted by loosening nuts 33 without removing them until the cover is capable of being moved away from the vertical wall 25 a distance to permit locating pins 36 to be inserted into a different pair of locating holes 37. Nuts 33 are then retightened. Three (3) locating holes are shown but other numbers of holes may be employed to accommodate fasteners of two or more differing lengths.

I claim:

1. In a magazine for a fastener tool which magazine is capable of holding and delivering fasteners of one length and thereafter capable of being adjusted to accommodate fasteners of a different length, the improvement comprising (a) an elongated fastener holding and delivering chamber having an opening therealong including fastener support floor spaced relative to said opening for supporting a plurality of fasteners thereon and a vertical wall attached to the support floor;

(b) a hold-down L-shaped cover element attachable to the vertical wall and including a cover lid at least partially closing said opening and a cover side piece substantially at a right angle to the cover lid;

(c) adjustable interconnecting means for connecting the cover element to the vertical magazine wall comprising bolt means on the magazine wall, a slot in the cover side piece to receive the bolt means and adjustable engaging means movable along the bolt means for engaging and disengaging the cover side piece to and from the magazine wall; and (d) alignment positioning means for selectively positioning in a plurality of positions the cover element with respect to and the magazine wall comprising projection pin means and plurality of complementary holes for receiving the projection pin means, the projection means positioned on one member and each complementary hole placed in the other member.

2. The magazine of claim 1 in which the adjustable engagement means is not removable from the bolt means.

* * * * *